US006848573B2

(12) United States Patent
Gould et al.

(10) Patent No.: US 6,848,573 B2
(45) Date of Patent: Feb. 1, 2005

(54) CARTON HAVING A HANDLE

(75) Inventors: Stephen Mark Gould, Bristol (GB); Emili Requena Miret, Igualada (ES)

(73) Assignee: Graphic Packaging International, Inc., Marietta, GA (US)

( * ) Notice: Subject to any disclaimer, the term of this patent is extended or adjusted under 35 U.S.C. 154(b) by 49 days.

(21) Appl. No.: 10/333,271

(22) PCT Filed: Jun. 29, 2001

(86) PCT No.: PCT/GB01/02945

§ 371 (c)(1),
(2), (4) Date: May 27, 2003

(87) PCT Pub. No.: WO02/08085

PCT Pub. Date: Jan. 31, 2002

(65) Prior Publication Data

US 2003/0188984 A1 Oct. 9, 2003

(30) Foreign Application Priority Data

Jul. 20, 2000 (GB) ..... 0017723

(51) Int. Cl.[7] ..... B65D 75/00

(52) U.S. Cl. ..... 206/141; 206/162; 206/427; 229/117.13

(58) Field of Search ..... 206/141, 162, 206/163, 165, 170, 200, 427, 428; 229/117.12–117.17

(56) References Cited

U.S. PATENT DOCUMENTS

| | | | | | |
|---|---|---|---|---|---|
| 3,164,316 | A | * | 1/1965 | Wurster et al. | 229/117.13 |
| 4,546,914 | A | * | 10/1985 | Roccaforte | 229/117.13 |
| 4,817,866 | A | * | 4/1989 | Wonnacott | 206/427 |
| 5,328,081 | A | * | 7/1994 | Saulas | 229/117.12 |
| 5,639,017 | A | * | 6/1997 | Fogle | 229/117.13 |
| 5,647,483 | A | * | 7/1997 | Harris | 206/427 |
| 5,772,030 | A | | 6/1998 | Baxter | |
| 6,065,590 | A | | 5/2000 | Spivey | |

FOREIGN PATENT DOCUMENTS

DE 29909003 9/1999

* cited by examiner

*Primary Examiner*—Luan K. Bui
(74) *Attorney, Agent, or Firm*—Womble Carlyle Sandridge & Rice, PLLC

(57) ABSTRACT

A fully enclosed carton for containing a plurality of articles such as bottles or cans formed from a blank. The blank includes a top, a base, end flaps, a first side wall and a second side wall. The second side wall provides a strap handle and a secondary side panel which is connected to the second side wall by Z-fold arrangements. In use, the secondary side panels lie between the strap handle, generally with a printed side facing up.

15 Claims, 3 Drawing Sheets

CARTON HAVING A HANDLE

This application claims priority under 35 U.S.C. §119(b) to British application serial no. 0017723.8, filed on Jul. 20, 2000 and PCT application serial no. PCT/GB00/02945, filed on Jun. 29, 2001 under 35 U.S.C. Å363.

BACKGROUND OF THE INVENTION

This invention relates to a carton having a handle, and more particularly to fully enclosed cartons for containing a plurality of articles such as cans or bottles.

SUMMARY OF THE INVENTION

According to a first aspect of the present invention there is provided a paperboard carton for a plurality of articles, the carton comprising a top, a base, two oppositely disposed ends and two oppositely disposed sides, one of the sides comprising a main side panel having an elongate strap handle defined between two lengthwise extending cuts, said one side panel being associated with a secondary side panel which is hingedly connected to said one side panel by one or more Z-fold arrangements and which is adhesively secured to said one side panel, but not to the strap handle overlying a portion of the secondary side panel.

In many arrangements said main side panel has a pair of oppositely disposed end flaps hingedly connected thereto. Preferably said cuts defining the handle extend into the end flaps.

Ideally two spaced Z-fold arrangements link the main and secondary side panels. In preferred arrangements, the Z-fold arrangements comprise a pair of oppositely disposed end hinge panels, hingedly connected to respective end flaps and hingedly connected to said secondary side panel which extends between and connects said end hinge panels.

Preferably said end hinge panels incorporate secondary end cuts in alignment with the parts of said handle defining cuts in the end flaps. It is another preferred feature that the secondary side panel has minor cuts at each end in alignment with the lengthwise cuts in the main side panel.

In preferred arrangements the secondary side panel underlies only portions of the main side panel, but not the end flaps.

Ideally a lengthwise extending gluing panel is hingedly connected to the main side panel and is formed from the paperboard originally located between the end hinge panels prior to folding the Z-fold arrangements.

In preferred arrangements, the end hinge panels each have an extension tab extendingly inwardly in the lengthwise direction towards the other extension tab, said hinge connection of the secondary side panel to the end hinge panels being provided by said extension tabs.

With some arrangements, the strap handle portion of said one side is reinforced, possibly by the adhesion of a paper or plastic strip to its inside surface. Also the cuts defining the strap handle have frangible bridges which are broken when the strap handle is first used. The strap handle may also incorporate central lateral flaps for folding under the handle to improve comfort. Conveniently a finger hole is provided adjacent the strap handle to facilitate grasping of the strap handle.

According to a second aspect there is provided a blank for producing the above carton, the blank preferably being supplied to a consumer with the Z-fold arrangements folded and the secondary side panel adhesively secured to said one side panel.

BRIEF DESCRIPTION OF THE DRAWINGS

An embodiment of the present invention will now be described in more detail. The description makes reference to the accompanying drawings in which.

DETAILED DESCRIPTION

Figure 1:
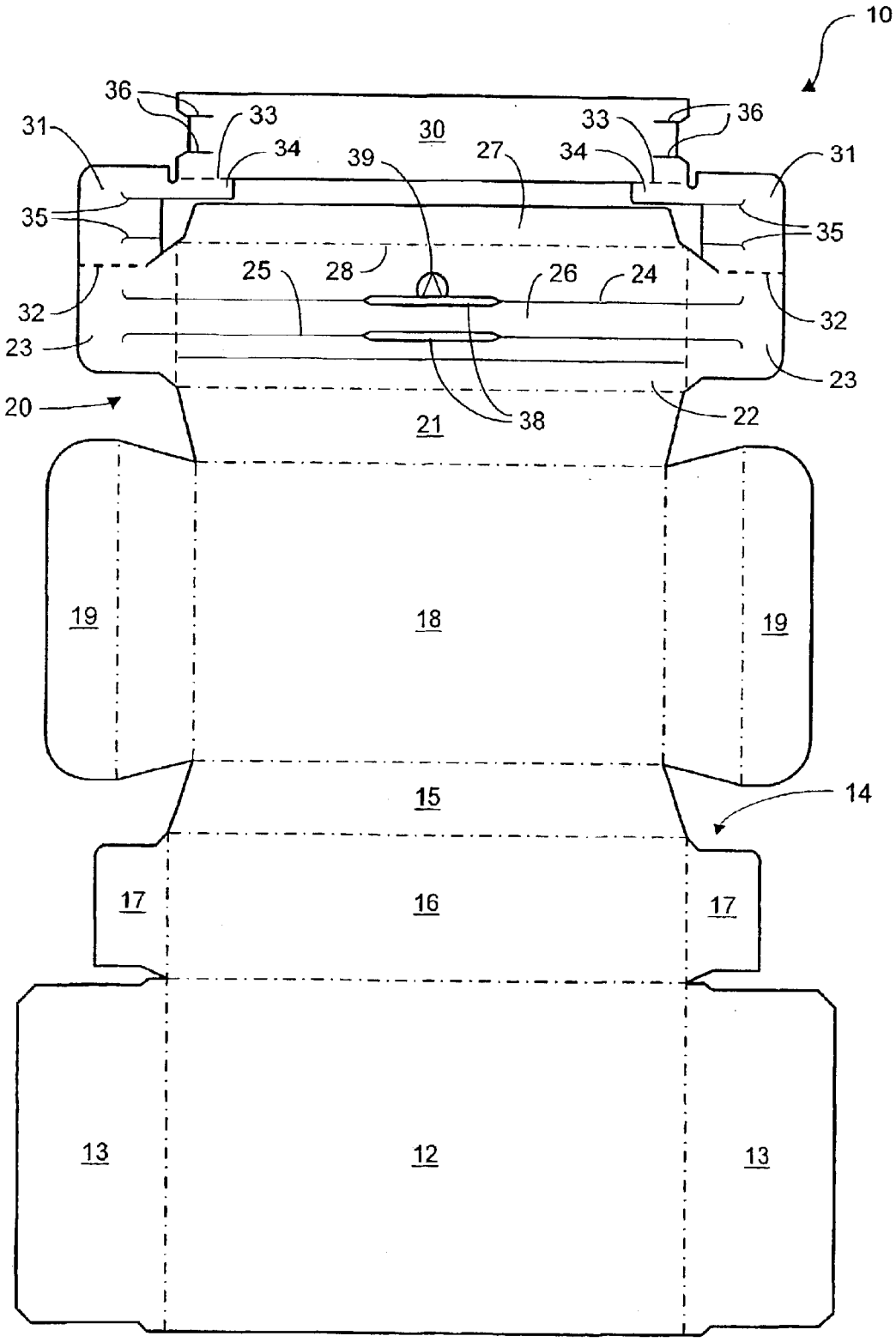
FIG. 1 shows a blank for producing a carton according to the present invention.

In the figures there is shown a paperboard blank 10 for producing a fully enclosed carton 11 containing a plurality of articles such as bottles. It will be appreciated that shape and dimensions of the carton could be, adapted for other articles such as cans in various different arrangements.

The blank 10 provides a base 12 having two lower end flaps 13 hingedly connected thereto. A first side wall 14 is hingedly connected to one side edge of the base 12 and is divided into upper and lower sections 15, 16 to accommodate the basic shape of bottles. The first side wall has side end flaps 17 hingedly connected to the lower section 16 and a top panel 18 is hingedly connected to the upper section 15. The top panel 18 has hingedly connected upper end flaps 19 and, opposite the first side wall 14, a second side wall 20.

Each second side wall 20 has upper and lower sections 21, 22, the lower section having hingedly connected side end flaps 23 and having a pair of spaced cuts 24, 25 which define therebetween a strap handle 26. The cuts 24, 25 extend a distance into the end flaps 23. An adhesive panel 27 is hingedly connected at 28 to the lower section 22 of the second side wall 20.

The end flaps 23 are hingedly connected by way of Z-fold arrangements to a secondary side panel 30. Each Z-fold arrangement comprises an end hinge panel 31 which is hingedly connected by way of folds 32 to the side end flaps 23 and by way of folds 33 on extension tabs 34 to the secondary side panel 30. The adhesive panel 27 is conveniently formed from the paperboard between the two end hinge panels 31. Folds 32 are aligned with each other and are parallel to the folds 33 which are also aligned with each other. Folds 32, 33 are also parallel with the folds joining side walls 14, 20 to the top 18 and base 12.

Prior to assembly of the carton 11 the secondary side panel 30 and end hinge panels 32 are folded about hinges 32, 33 in a Z-like manner so that the secondary side panel 30 is disposed behind the lower section 22 of the second side wall 20. This step is clearly shown in FIG. 2. Adhesive is applied so that the secondary side panel 30 is adhered to the eventual underside of the second side wall 20, but not between the two cuts 24, 25. The end hinge panels 31 are also adhered to the side end flaps 23 and are provided with cuts 35 for alignment with the parts of cuts 24, 25 in the side end flaps 23. The secondary end panel 30 also has short cuts 36 aligned with the cuts 24, 25 to enable the strap handle 26 to move out of alignment with the second side wall 20 when the pack is being carried.

Figure 2:
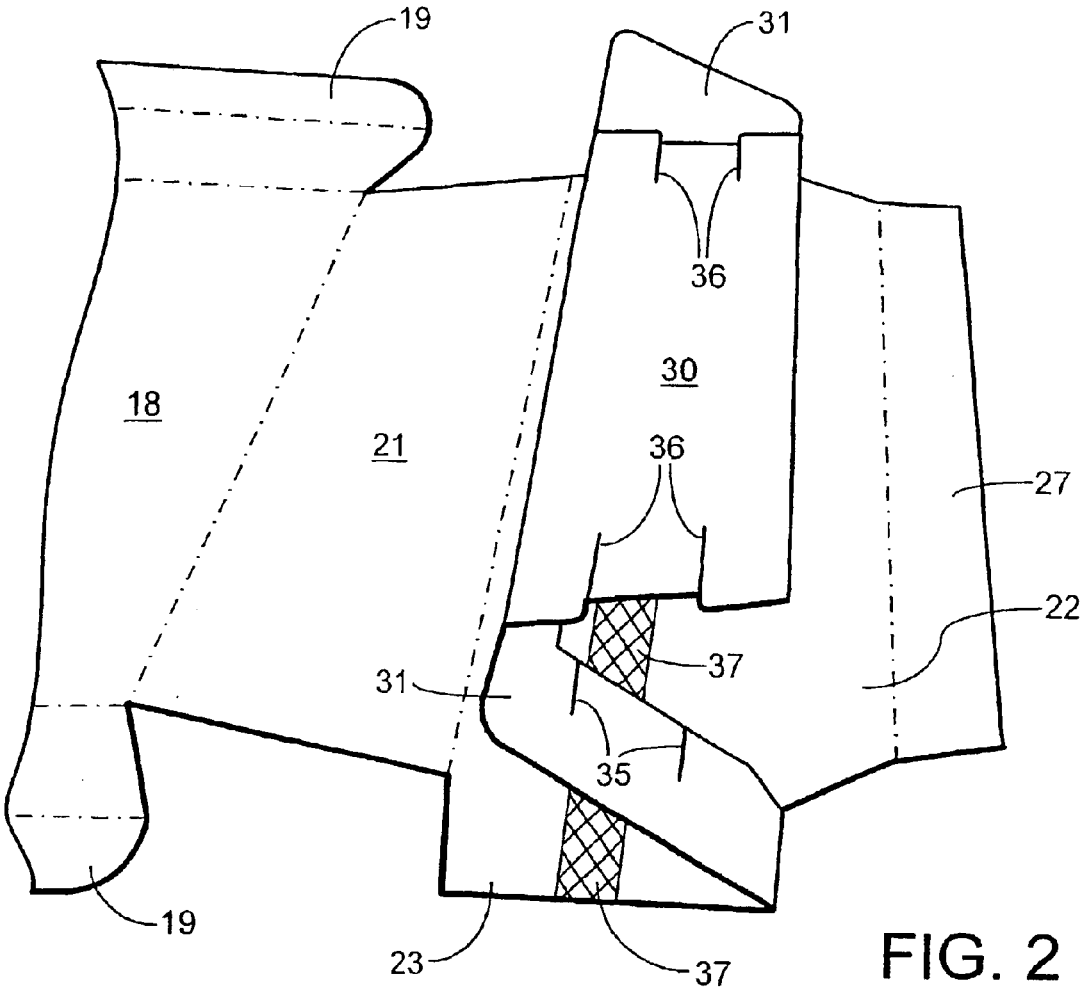
FIG. 2 is a perspective view of a secondary side panel of the FIG. 1 blank in a partially folded condition.
Figure 4:
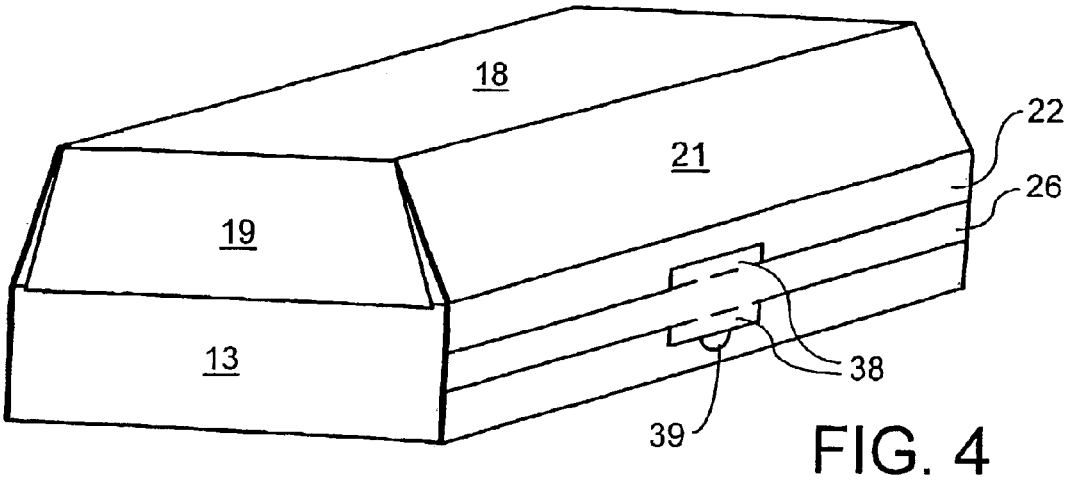
FIG. 4 is a perspective view of the fully assembled carton with its handle being used.

FIG. 2 also shows an optional reinforcement strip 37 secured to the underside of the strap handle 26. The strip 37 may be made of paper, paperboard, plastic or any other suitable material.

The part folded blanks, that is with the secondary side panels 30 folded and glued to the second side wall 20, can then be stacked and forwarded to an end user for running on a packaging machine. The part folding step could of course also be run as an additional feature on a packaging machine prior to folding about the articles.

Figure 3:
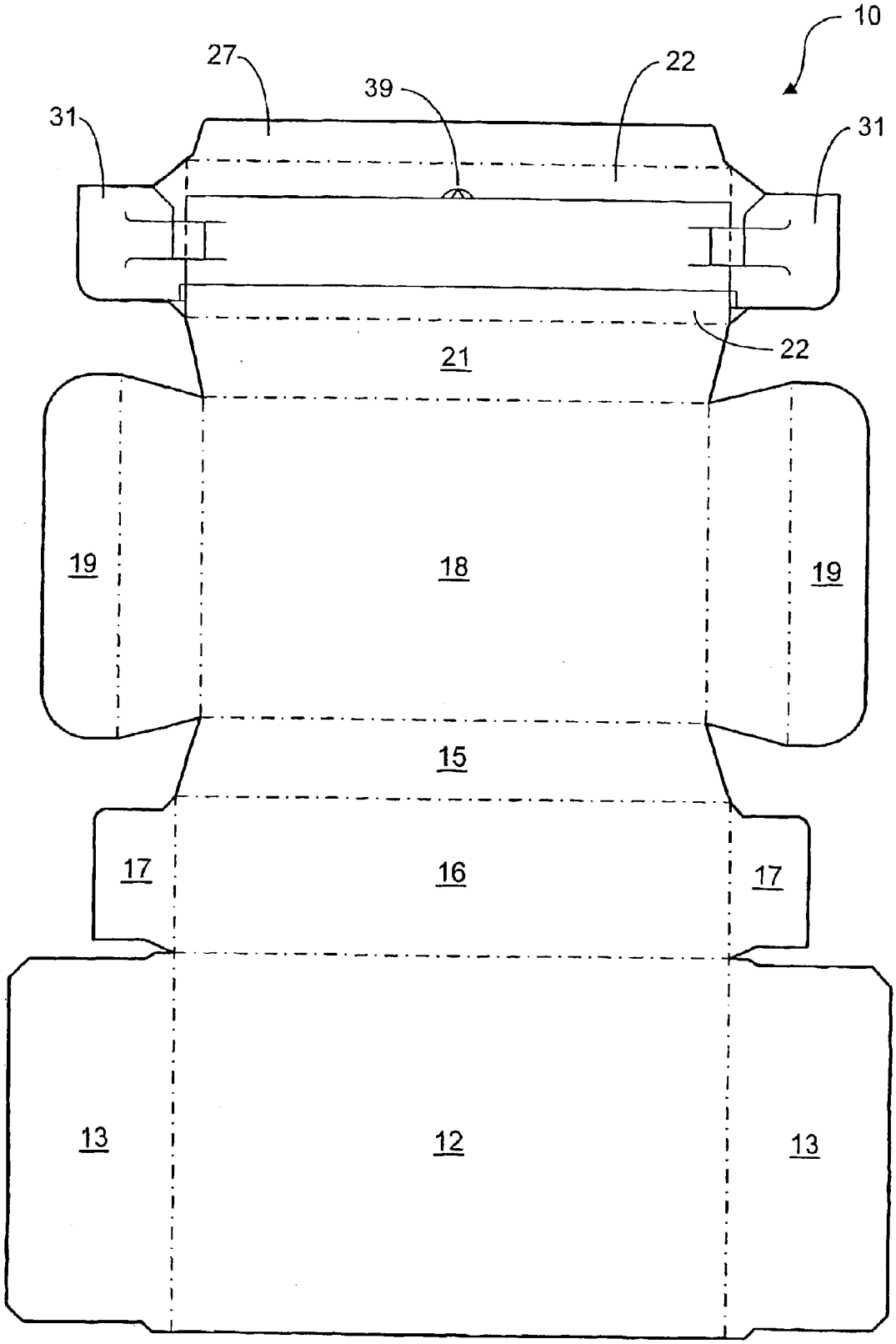
FIG. 3 is a view of the blank of FIG. 1 with the secondary side panel folded.

When the part folded blank of FIG. 3 is formed into a carton 11, the adhesive panel 27 is secured to the base 12 thereby forming a sleeve like structure, either about the articles to be contained or to enable the articles to be inserted into the sleeve. The side end flaps 17, 23 are then folded inwards and the upper and lower end flaps 13, 19 folded and adhesively secured together and to the side end flaps 17, 23. It will be understood that the end flaps gluing sequence ensures that the upper and lower end panels are not secured to the strap handle 26.

Ideally the cuts 24, 25 defining the strap handle 26 incorporate small bridges which are broken when the handle is used. The handle then arcs by virtue of the cuts 24, 25 extending into the end flaps 23. The Z-fold arrangements connecting the secondary side panel 30 mean that the secondary side panel 30 is visible when the handle is used. Furthermore the printable side of the secondary side panel is visible (the paperboard for such packs is only printed on one side), thereby maintaining a quality appearance.

The cuts 24, 25 may also define central lateral flaps 38 for folding under the handle 26 to make it more comfortable. A finger hole 39 may also be provided in the second side panel 20 adjacent the handle 26 to facilitate grasping of the handle.

It will be appreciated that the handle need not be formed in the side panel, but in any other panel of the carton.

What is claimed is:

1. A paperboard carton for a plurality of articles, the carton comprising a top, a base, two oppositely disposed ends and two oppositely disposed sides, one of the side comprising a main side panel having an elongate strap handle defined between two lengthwise extending cuts, said one side panel being associated with a secondary side panel which is hingedly connected to said one side panel by one or more Z-fold arrangements and which is adhesively secured to said one side panel, but not to the strap handle overlying a portion of the secondary side panel.

2. A paperboard carton as claimed in claim 1 wherein said main side panel has a pair of oppositely disposed end flaps hingedly connected thereto.

3. A paperboard carton as claimed in claim 2 wherein said cuts defining the handle extend into the end flaps.

4. A paperboard carton as claimed in claim 2 wherein two spaced Z-fold arrangements link the main and secondary side panels.

5. A paperboard carton as claimed in claim 4 wherein the Z-fold arrangements comprise a pair of oppositely disposed end hinge panels, hingedly connected to respective end flaps and hingedly connected to said secondary side panel which extends between and connects said end hinge panels.

6. A paperboard carton as claimed in claim 5 wherein paid end hinge panels incorporate secondary end cuts in alignment with the parts of said handle defining cuts in the end flaps.

7. A paperboard carton as claimed in claim 5 wherein a lengthwise extending gluing panel is hingedly connected to the main side panel and is formed from the paperboard originally located between the end hinge panels prior to folding the Z-fold arrangements.

8. A paperboard carton as claimed in claim 5 wherein the end hinge panels each have an extension tab extendingly inwardly in the lengthwise direction towards the other extension tab, said hinge connection of the secondary side panel to the end hinge panels being provided by said extension tabs.

9. A paperboard carton as claimed in claim 2 wherein the secondary side panel underlies only portions of the main side panel, but not the end flaps.

10. A paperboard carton as claimed in claim 1 wherein the secondary side panel has minor cuts at each end in alignment with the lengthwise cuts in the main side panel.

11. A paperboard carton as claimed in claim 1 wherein the strap handle portion of said one side is reinforced, possibly by the adhesion of a paper or plastic strip to its inside surface.

12. A paperboard carton as claimed in claim 1 wherein the cuts defining the strap handle having frangible bridges which are broken when the strap handle is first used.

13. A paperboard carton as claimed in claim 1 wherein the strap handle also incorporates central lateral flaps for folding under the handle.

14. A paperboard carton as claimed in claim 1 wherein a finger hold is provided adjacent the strap handle to facilitate grasping of the strap handle.

15. A paperboard blank for producing a carton as claimed in claim 1.

* * * * *